United States Patent [19]

Ito

[11] Patent Number: 4,557,432

[45] Date of Patent: Dec. 10, 1985

[54] STROKE APPARATUS

[76] Inventor: Ryoichi Ito, 12-2 Uguisudani-cho, Shibuya-ku, Tokyo, Japan

[21] Appl. No.: 728,089

[22] Filed: Apr. 29, 1985

Related U.S. Application Data

[63] Continuation-in-part of Ser. No. 520,860, Aug. 8, 1983, abandoned.

[30] Foreign Application Priority Data

Aug. 10, 1982 [JP] Japan ..... 57-137995

[51] Int. Cl.[4] ..... B65H 54/28

[52] U.S. Cl. ..... 242/158 R; 74/22 R

[58] Field of Search ..... 242/158 R, 158.4 R, 242/25 R; 74/22 R, 22 A, 25, 27

[56] References Cited

U.S. PATENT DOCUMENTS 2,940,322 6/1960 Uhing ..... 242/158 R X

FOREIGN PATENT DOCUMENTS 12901 4/1972 Japan ..... 242/158 R

*Primary Examiner*—Stanley N. Gilreath

*Attorney, Agent, or Firm*—George B. Oujevolk

[57] ABSTRACT

The stroke apparatus contemplated herein comprises a plurality of annular races each having an inner annular surface of an arcuately bulging cross-section and rotatably accommodated in a support. These annular races are rotatably journaled in a housing in an alternately offset or staggering fashion. A rotary shaft extends through these annular races, and one of the race supports has a pivotal shaft placed at the center of, or at a shifted position from, the corresponding other races and the upper and lower race supports have their pivotal shafts placed in positions shifted to the opposite sides of the rotary shaft. The bulging cross-sections of each of the annular races is forced in contact with the rotary shaft. A guide stem is provided in parallel with the rotary shaft and engaging said housing for sliding movement therealong.

1 Claim, 8 Drawing Figures

STROKE APPARATUS

This is a continuation-in-part of application Ser. No. 520,860, filed Aug. 8, 1983, now abandoned.

BACKGROUND OF THE INVENTION

This invention relates to a stroke apparatus for reciprocatingly guiding a fibrous or metallic filament or wire uniformly over the surface of a take-up bobbin so as to permit the filament or wire to be taken up in a uniformly distributed layer on the peripheral surface of the bobbin.

DESCRIPTION OF THE PRIOR ART

The prior art stroke apparatus of the kind concerned comprises a plurality of annular races each having an inner annular surface of an arcuately bulging crosssection and rotatably accommodated in a support. The support has an integral outer pivotal shaft extending through the center of the annular races, a housing wherein the annular races are rotatably journaled in a staggering fashion, and a rotary shaft extends through the annular races. The bulging crosssections of each of these annular races are forced in contact with the rotary shaft and the contiguous races are mechanically connected with each other in a complementary angle relative to the rotary shaft. This conventional apparatus requires a mechanism for connecting a plurality of annular races or their supports which has made the apparatus overall complicated and heavy.

SUMMARY OF THE INVENTION

An object of this invention is to provide a high-performance stroke apparatus having a simplified, light weight construction substantially free of occurrance of hitches and capable of stabilized operation with a pitch or speed of stroke being smoothly adjustable.

DETAILED DESCRIPTION OF THE EMBODIMENTS

Figure 1:
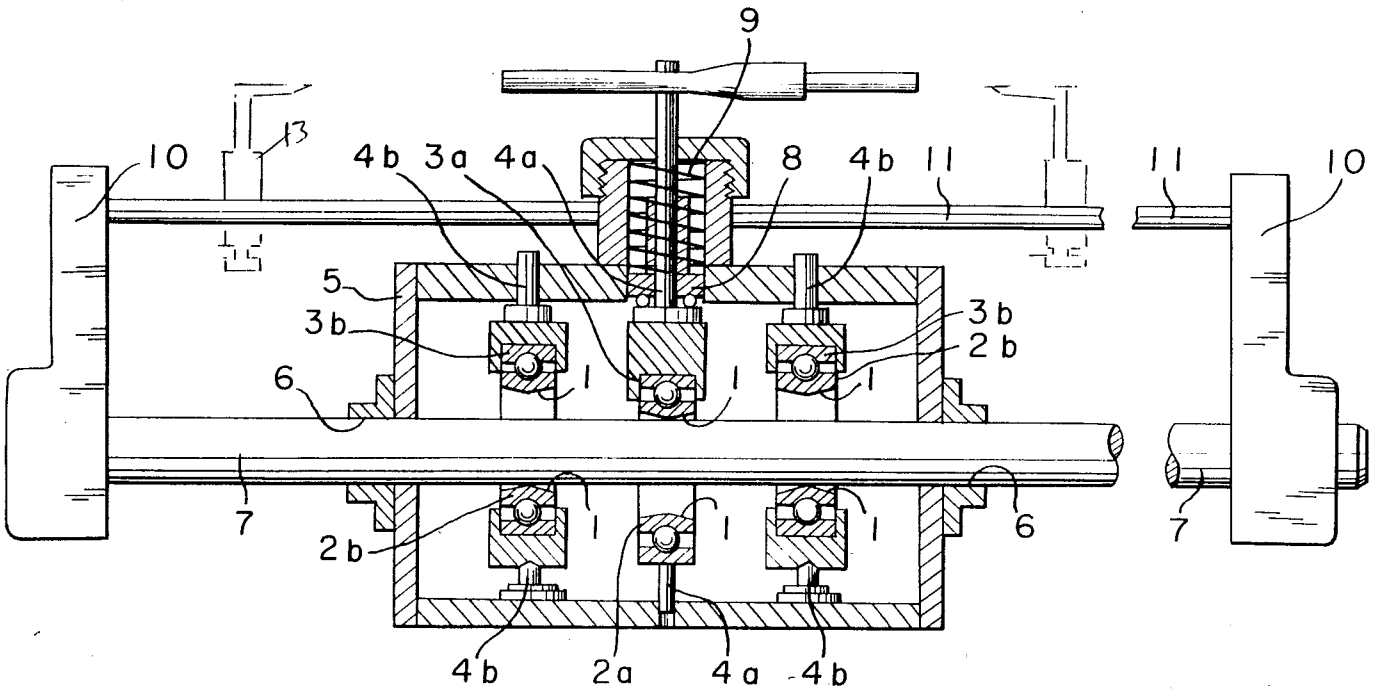
FIG. 1 is a longitudinally sectional view of one embodiment of the invention.
Figure 2:
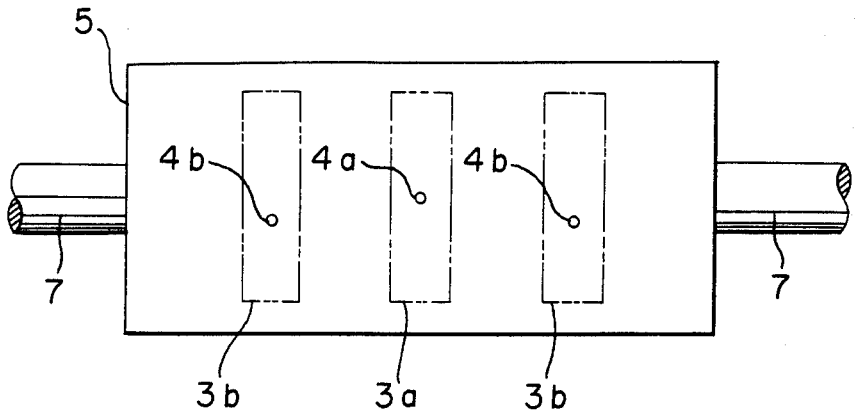
FIG. 2 represents a simplified bottom view of an embodiment of the invention.
Figure 3:
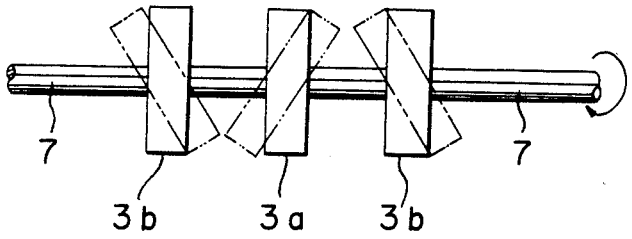
FIG. 3 depicts a diagram showing an operative relationship between the annular races and rotary shaft of the invention

FIGS. 1, 2, 3, and 7 show collectively an embodiment of the invention where a plurality of annular races 2*a*, 2*b* each have an inner annular surface of an arcuately bulging cross-section 1 and are rotatably accommodated in a support 3*a*, 3*b* by spherical bearings. The supports 3*a*, 3*b* are spaced equidistantly and are arranged as-here-in-after described. Outside of the support 3*a*, two pivotal shafts 4*a*, extend out from diagonally opposite locations on the periphery of the central annular race 2*a*. The two outer annular races 2*b*, have similar pivotal shafts 4*b*, extending out from locations on the periphery of the two outer races, but each offset from the pivotal shaft 4*a* of the central race 2*a*. Thus, the annular races are all journaled rotatably in a housing 5 which has opposite end openings 6 lying in an extension of a theoretical horizontal line extending through all the annular races and a rotary shaft 7 extending along this same horizontal line. Thus, the central race and the two outer races are all connected to the housing in a vertical fashion. But the two outer races are both offset an equal distance from the center race as shown in FIG. 2. The rotary shaft 4*a* of the center annular race 2*a* is biased vertically by a spring 9 which directly exerts an urging force to a float seat 8 fitted on the pivot of the rotary shaft. The urging force brings the upper section of the inner surface of the annular race 2*a* into contact with the rotary shaft 7. The compressing force thus exerted on the rotary shaft is supported by the lower section of the inner surfaces of the outer annular races 2*b*. The rotary shaft 7 is mounted rotatably on a spaced pair of support arms 10,10. The housing is engaged on a guide stem 11 rigidly extending between the pair of support arms in parallel with the rotary shaft 7, so that the housing is guided along the stem in a stable posture. To adjust the distance traveled by the embodiment shown, adjustable stops 13 are provided on the guide stem 11.

Figure 4:
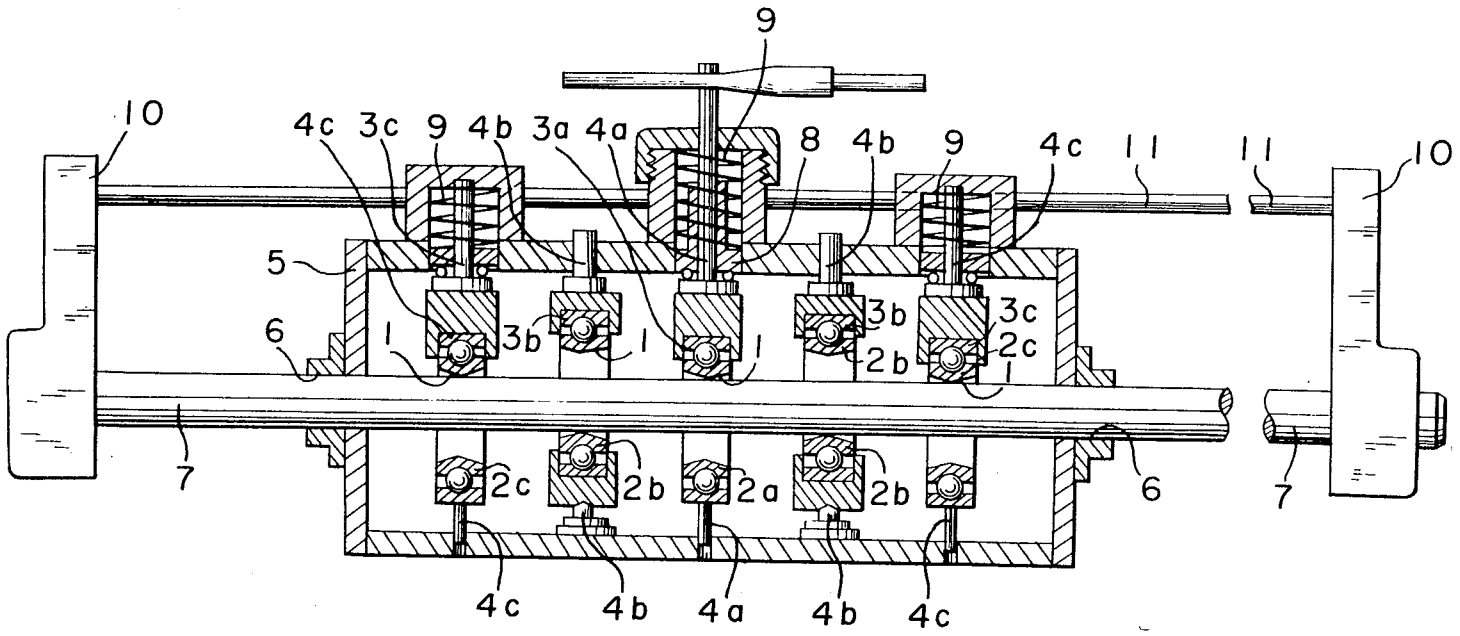
FIG. 4 is a longitudinally sectional view of another embodiment of the invention.
Figure 5:
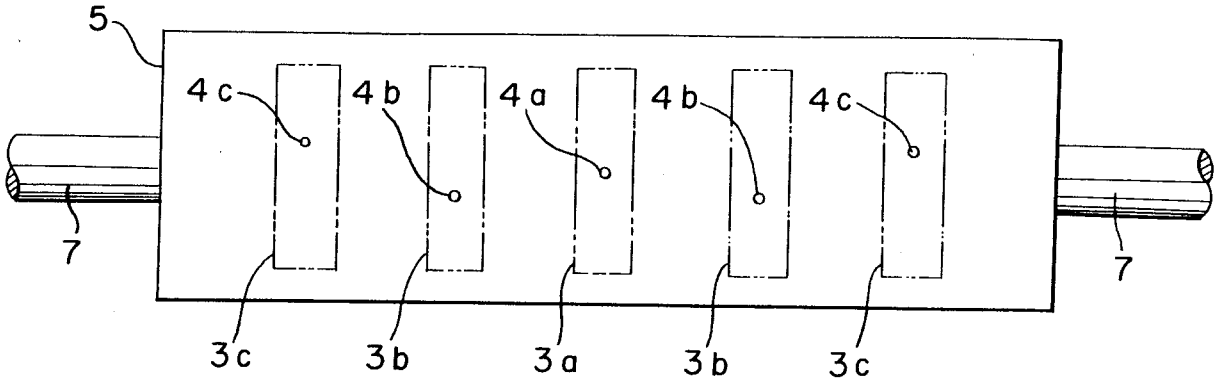
FIG. 5 represents a simplified bottom view of the other embodiment of the invention.
Figure 6:
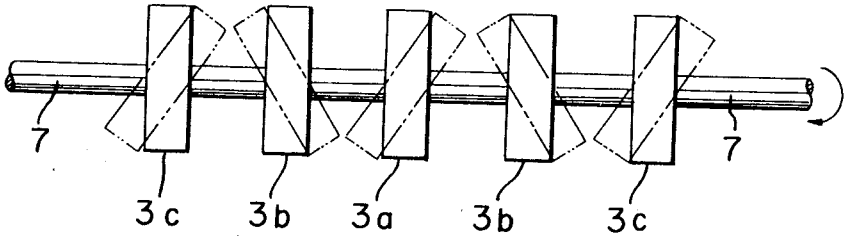
FIG. 6 depicts a diagram showing an operative relationship between the annular races and rotary shaft of the other embodiment of the invention.
Figure 7:
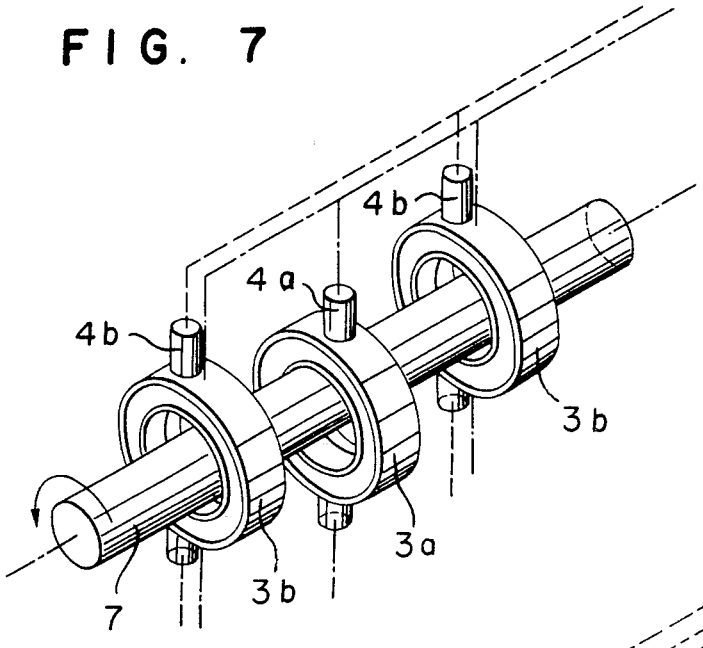
FIG. 7 is a perspective view of the embodiment shown in FIG. 1.
Figure 8:
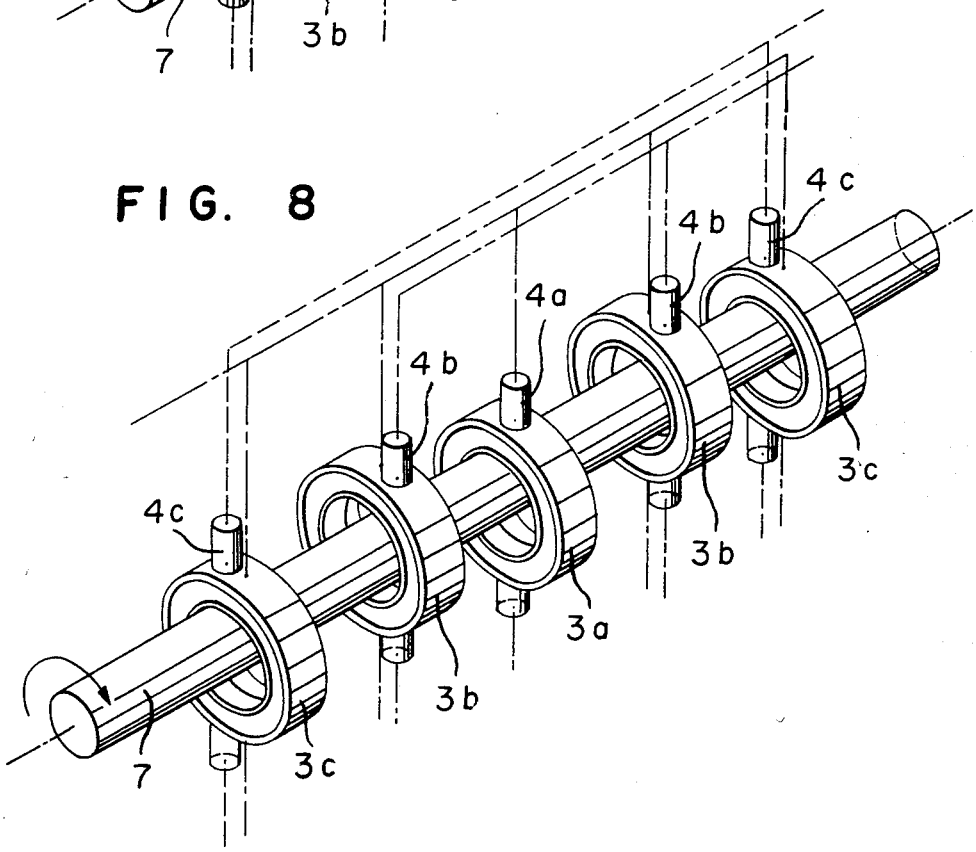
FIG. 8 shows a similar perspective view of the embodiment shown in FIG. 4.

FIGS. 4 to 6 shows another embodiment of the invention which is similar to the above described one except that five supports and annular races are equidistantly arranged to be alternately offset such that every other race has the upper portion of the inner surface forced in contact with the periphery of the rotary shaft 7 by a spring 9. Pivotal shafts outside of the race supports are arranged so that those in a laterally inner pair of the race supports 3*b*, contiguous to the center race support 3*c*, are disposed in a position shifted from each other in the opposite direction.

The number of races is not restricted to three or five like in the embodiments described, but the invention may apply to many races.

The operation of the embodiments will now be described; where the advantages of the invention will be clarified. Upon energization of a power source to rotate the rotary shaft 7, the annular races forced in contact with the rotary shaft will rotate. The race support 3*a* thereby turns in a direction shown in the broken lines to an inclination relative to the rotary shaft 7. When the rotary shaft 7 rotates in a direction shown by the arrow in FIG. 3, a component force to the left direction of the figure will be generated in the annular race 2*a*, eventually bringing the housing in the left direction of the figure. Annular races 2*b*, to the left and right of race 2*a* are forced by the rotary shaft 7 in the opposite direction to the center race. These races receive a reverse rotational torque about the pivotal shaft 4*b* to that acting on the center annular race 2*a* by the rotational force of the rotary shaft 7, so that the outer races are limited at a angle relative to the rotary shaft 7 proportional to the displacement force of the shaft. Similarly, in FIGS. 4, 5 and 6, the outer annular races 2*c*, 2*c* are caused to turn about the pivotal shaft 4*c* in a direction opposite to the direction of turning of the race support 3*b*. Inversion of the annular race 2*a* or reverse rotation of the rotary shaft 7 can displace the housing in the opposite direction. The speed of displacement of the housing can be freely adjusted by varying an angle of the annular races 2 relative to the rotary shaft.

From the foregoing, it is understood that the invention provides a stroke apparatus replacing the conventional link mechanism between supports by a plurality of annular races capable of turning in directions which are to be determined relative to the rotary shaft by the displacement force of the latter, so that the mechanism overall is simpler and lighter, and being superior economically and rationally in thus eliminating causes of troubles.

What is claimed is:

1. A stroke apparatus, comprising in combination:

(a) an elongated frame having a pair of spaced support arms (10) and a guide rail (11) extending between said support arms;

(b) a horizontal rotary shaft (7) rotatably mounted between the support arms (10);

(c) a housing (5) with opposite openings (6) said rotary shaft (7) passing through and being journaled in said openings;

(d) at least outer first, a center second and outer third annular vertical races (**2*b*,2*a*), said races having a defined top and bottom, and supported in said housing (5) equidistant from each other, each race having a central opening with an inner annular surface of arcuately bulging cross-section, the shaft (7**) passing through said races, the central opening of said races being substantially larger than the diameter of said shaft;

(e) pivotal shaft supports (**3*b*,3*a*), supporting each race, and also respectively supporting an outer first, a center second and an outer third shaft (4*b*,4*a*), the axis of the center shaft (4*a*) being perpendicular to and intersecting the rotary shaft (7), the axes of the outer first and third shafts being both equidistantly offset from said rotary shaft (7**), all three shafts being parallel;

(f) spring means (9) affixed to said center second race (**2*a*), biasing the bulging section of said center second race against said rotary shaft (7) so that the top of said race bulging section is in contact with said shaft, and said outer first and outer third races being so disposed that said shaft is in contact with the bottom of the outer first and outer third races so that said outer first and outer third races are vertically aligned, whereas the center second race is vertically offset from the outer first and outer third races, the bottom of said center second race being below the bottom of said outer first and outer third races; where-by, when said rotary shaft (7) turns, because of the bulging center section, and the outer first and third shafts (4*b*) having their axes offset from the center shaft (4*a*), the center race tends to incline at an angle from the vertical in one direction while the outer first and outer third races tend to incline in the opposite direction, the torque tending to cause the angle of incline being proportional to the rotational speed of the rotary shaft (7**).

* * * * *